United States Patent [19]

Bryda et al.

[11] Patent Number: 4,734,967

[45] Date of Patent: Apr. 5, 1988

[54] METHOD OF HEAT TREATING BEARING MATERIALS

[75] Inventors: Kenneth A. Bryda, Euclid; Hans G. Lanner, Willoughby Hills; Rodney W. Stutzman, Willowick; William A. Yahraus, Mentor, all of Ohio

[73] Assignee: Imperial Clevite Inc., Cleveland, Ohio

[21] Appl. No.: 869,489

[22] Filed: Jun. 2, 1986

[51] Int. Cl.[4] ..... B22F 7/02

[52] U.S. Cl. ..... 29/149.5 R; 29/149.5 PM; 148/11.5 A; 148/906; 419/6; 419/29

[58] Field of Search ..... 29/148.4 R, 148.4 A, 29/148.4 C, 149.5 R, 149.5 PM, 149.5 S, DIG. 31; 148/11.5 A, 906, 159; 419/3, 6, 28, 29; 428/557

[56] References Cited

U.S. PATENT DOCUMENTS

| | | | |
|---|---|---|---|
| 3,198,676 | 8/1965 | Sprowls et al. | 148/159 |
| 3,637,441 | 1/1972 | Lyle, Jr. et al. | 419/29 X |
| 3,797,084 | 3/1974 | Fedor et al. | 29/149.5 PM |
| 4,069,369 | 1/1978 | Fedor et al. | 420/548 X |
| 4,121,928 | 10/1978 | Mori | 29/149.5 PM X |
| 4,361,629 | 11/1982 | Mori | 29/149.5 PM X |
| 4,462,843 | 7/1984 | Baba et al. | 148/11.5 A |
| 4,605,448 | 8/1986 | Baba et al. | 148/11.5 A |

*Primary Examiner*—Howard N. Goldberg
*Assistant Examiner*—Taylor J. Ross
*Attorney, Agent, or Firm*—Harness, Dickey & Pierce

[57] ABSTRACT

An improved method of producing a powdered metal aluminum base bearing material is provided. A bearing strip composed of three layers of sintered aluminum base particles which has been roll clad to a rigid backing layer is subjected to a heat treatment procedure in a continuous manner at a temperature of from about 700° F. to about 900° F. for at least thirty seconds and then cooled at a rate of at least 100° F./hr. Bearings made from the resulting material show dramatic fatigue life improvement in comparison to that obtainable with currently available powdered metal aluminum bearing materials.

6 Claims, 2 Drawing Sheets

METHOD OF HEAT TREATING BEARING MATERIALS

BACKGROUND OF THE INVENTION

Figure 1:
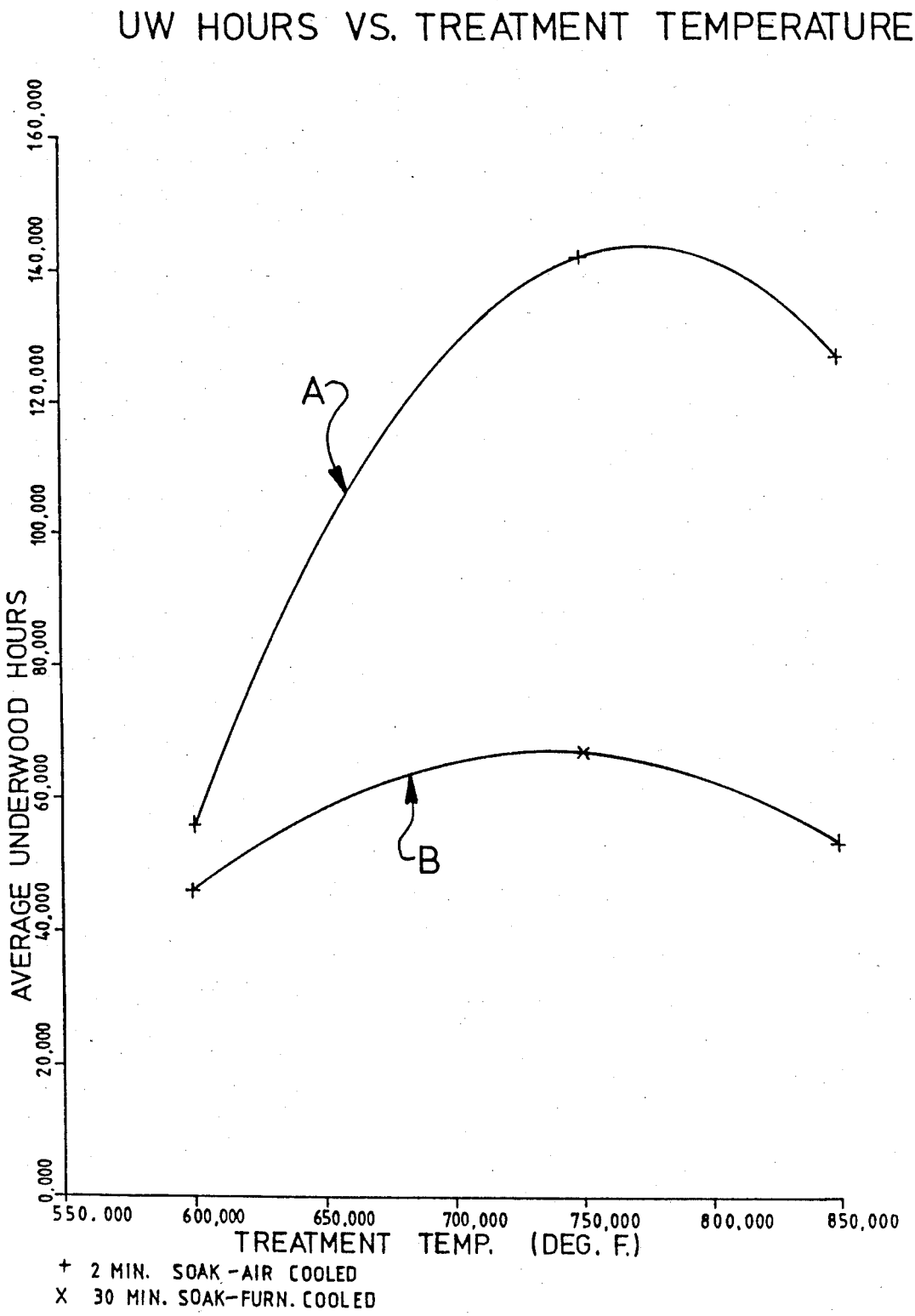

The present invention relates generally to an aluminum base bearing made by powder metallurgy techniques and, more particularly, to a bearing having a surface layer of pre-alloyed aluminum base particles.

It has been known to make aluminum base bearings by powder metallurgy techniques containing a bearing phase of conventional materials such as lead, tin, copper, cadmium, etc. However, considerable difficulty has been experienced in the fabrication and use of such bearings, especially in imparting superior bearing load carrying capacity and anti-seizure properties to the bearing structure. One method used to achieve improved bearing properties was to have a bearing layer in which the particles of the bearing layer are in pre-alloyed powder form, particularly where the bearing phase is in an intra-particle position relative to the aluminum. This bearing with a fine dispersion of the bearing phase in the individual aluminum particles and method of manufacture are described in U.S. Pat. Nos. 3,797,084, and 4,069,369 filed Dec. 18, 1972 and May 4, 1973, respectively, and owned by the assignee of the instant application.

The current trend toward higher output engines, such as turbo charged engines, has given rise to the need for even higher performance bearing materials. Presently, the only bearing materials which consistently meet the performance requirement of these higher output engines are overlay plated tri-metal bearings. These bearings while having good performance characteristics are expensive to produce, exhibit accelerated wear and provide clearance control problems.

Accordingly, it is a principal object of this invention to provide a method of making an aluminum based bearing by powder metallurgy techniques which has improved bearing load carrying capacity and anti-seizure properties.

SUMMARY OF THE INVENTION

In one aspect, the present invention relates to a method of producing a powdered metal aluminum base bearing material having superior fatigue and anti-seizure properties which method comprises:

(a) simultaneously roll compacting three distinct layers of aluminum base powder particles in which the bottom layer of said layers constitutes a powder metal bonding layer consisting essentially of more than 55 weight percent aluminum and the balance selected from a first group of additives consisting of silicon, copper, manganese, magnesium, nickel, iron, zinc, chromium, zirconium, titanium and mixtures thereof;

the intermediate layer of said layers constituting a powder metal bearing layer consisting essentially of at least 55 up to about 95 weight percent aluminum, with the balance selected from said first group of materials in an amount of 0 to about 20 weight percent and from a second group of bearing phase materials in the amount of 5 to 25 weight percent, said second group consisting of lead, tin, cadmium, bismuth, antimony and mixtures thereof;

the surface layer of said layers constituting a sacrificial layer deposited on said powder metal bearing layer and consisting essentially of more than 50 weight percent of aluminum particles and the balance of additives selected from said first and second groups, with said aluminum and said bearing phase materials of said bearing layer being placed in prealloyed particle form to establish an intra-particle position relative to each other and the bearing phase particles in said sacrificial layer being formed for establishing an interstitial position therein relative to the aluminum particles;

(b) sintering the so-formed three-layered composite; and (c) roll cladding the bonding layer face to face onto a rigid backing layer;

wherein the improvement comprises:

heat treating the roll clad composite material in a continuous manner to a temperature from about 700° F. to about 900° F. for a period of at least thirty seconds and then cooling the material at a rate of at least 100° F./hr.

In still another aspect, the instant invention concerns the bearing structure produced by the foregoing method.

DESCRIPTION OF THE PREFERRED PRACTICE OF THE INVENTION

The present invention relates to a method of producing bearing materials which exhibit properties not obtainable heretofore by prior art techniques.

As below noted, the instant invention represents a significant improvement over the method disclosed in U.S. Pat. Nos. 3,797,084 and 4,069,369. Specifically, this improvement is achieved via the unexpected discovery that a superior bearing material is produced when the thermal processing of the bearing material having a rigid backing layer clad thereto is controlled such that the material is heated at a temperature ranging from about 700° F. to about 900° F. for at least 30 seconds to effect alloy solutionizing and then rapidly cooled. The cooling rate is dependent upon the solution treating temperature wherein this rate is more rapid for the higher portion of the solution heat treating range than for the lower portion but in all cases more rapid than the 50° F./hr. associated with standard full annealing and in fact more rapid than 100° F./hr. That is, the cooling rate for the instant invention is higher for materials heated to 900° F. than for those heated to 700° F.

The techniques and materials utilized in the practice of the instant invention are generally described in U.S. Pat. No. 3,797,084 except for the above-described critical thermal treatment. Accordingly, for the sake of brevity the disclosure of the 3,797,084 patent will not be repeated here but simply incorporated by reference.

Thermal processing according to the instant invention has been totally redefined over the prior art. Specific elements of this redefinition are as follows:

(a) Post thermal processing is mandatory, not optional.

(b) The thermal processing has been changed from full annealing to solution treating. This change has produced the unexpected result of obtaining the strengthening effect of the copper and/or other alloy additions without experiencing the potential bearing surface property degradation generally associated with solution treating of bearing materials.

(c) The thermal treating temperature has been redefined from 600° F.-750° F. to 700° F.-900° F. to obtain effective solutionizing.

(d) The cooling rate has been changed from less than 50° F./hr. required for full annealing where material hardness is at a minimum and ductility is at a maximum to greater than 100° F./hr. to take advantage of the strengthening influences of the alloying elements. The preferred rate to maximize material properties is in excess of an average of 50° F./min. during the first three minutes of cooling.

Materials used in the practice of the present invention included:

(a) The bottom layer, i.e. the powder metal bonding layer, can consist essentially of more than 55 weight percent aluminum with the balance being selected from a first group of additives consisting of silicon, copper, manganese, magnesium, nickel, iron, zinc, chromium, zirconium, titanium and mixtures thereof.

(b) The intermediate layer, i.e. the powder metal bearing layer, can consist essentially of at least 55 and up to about 95 weight percent aluminum, with the balance selected from the first group of additive materials in an amount of 0 to about 20 weight percent and from a second group of bearing phase materials in the amount of 5 to 25 weight percent, the second group consisting of lead, tin, cadmium, bismuth, antimony and mixtures thereof.

(c) The surface layer, i.e., the sacrificial layer deposited on the powder metal bearing layer, can consist essentially of more than 50 weight percent of aluminum particles with the balance of additives being selected from the first and second groups.

In addition, the aluminum and the bearing phase materials of the bearing layer are in prealloyed particle form to establish an intra-particle position relative to each other and the bearing phase particles in the sacrificial layer are formed so as to establish an interstitial position therein relative to the aluminum particles.

The following is a detailed example showing the practice of the instant invention.

(1) An air atomize bearing powder material was produced by the techniques described in U.S. Pat. No. 3,797,084. The nominal composition in weight percent of the alloy was 7.5% lead, 1.5% tin, 0.9% copper, 4.0% silicon, with balance being aluminum.

(2) A sacrificial layer material was produced which had a nominal composition in weight percent of 80% aluminum, and 20% of an 85/15 lead-tin solder powder.

(3) A bonding layer material consisting of essentially pure aluminum was produced.

(4) The pure aluminum powder, bearing alloy powder, and sacrificial powder were simultaneously roll compacted to produce a green, three layered strip with the alloy powder interposed between the aluminum (bonding) layer and the sacrificial layer.

(5) The compacted strip, in coil form, was sintered in an air furnace at a temperature of 975° F.±25° F. for a minimum of 12 hours.

(6) Prior to roll bonding the above sintered strip to a steel substrate, it was heated for 2 hours at 400° F. followed by 2 hours at 800° F. to preclude moisture related blister formation. (This technique is preferred, but no mandatory).

(7) The sintered and thermally treated strip was roll bonded to a dead soft steel backing in the following preferred manner:

(a) Alkaline clean and rinse the steel;

(b) Grind the steel surface to remove oxides and provide fresh, rough surface for bonding;

(c) Wire brush the pure aluminum side of sintered strip to remove oxides and provide active bonding surface; and (d) Simultaneously pass the sintered strip with freshly prepared aluminum layer and ground steel backing, face to face, through a rolling mill, wherein the sintered strip is reduced in thickness a minimum of 55% and a metallurgical bond effected between the aluminum and steel.

(8) In the preferred method, an additional cold reduction of the steel/aluminum alloy composition of about 5% is achieved in another rolling operation which is performed after roll bonding.

(9) The finished rolled structure is thermally treated in a continuous manner wherein:

(a) The structure is heated to a temperature range of about 700° F. to about 900° F.;

(b) The structure is soaked for a time of at least 30 seconds but no longer than the time required for the formation of brittle aluminum/iron intermetallic. For example, the maximum time limit at 900° F. would typically be about five minutes.

(c) Cooling the so heat-treated structure at a rate of at least 100° F. per hour, and (d) In the preferred practice of the invention, the structure is heated to a temperature of about 750° F. to about 800° F. and soaked for a minimum of 2 minutes.

The following is a detailed description of various tests conducted to show the benefit of the instant invention.

Specifically, FIG. 1 illustrates the effect of post clad thermal treatments on bearing fatigue life as measured by the Underwood test. Bearings manufactured in accordance with this invention exhibited more than twice the life of those manufactured with the standard thermal process. Each data point represents the average of four test results. All tests were conducted at a unit load of 8000 PSI (theoretical peak film pressure of 117,500 PSI) and terminated at the first sign of cracking (failure).

All test bearings were made from material prepared in the manner described herein. This material came from the same source, i.e. a single coil.

All processing except the final thermal treatment was performed in production. A laboratory furnace was used for the treatments shown in FIG. 1. The air cooling cycle involved removing material from the furnace after it had soaked at the desired temperature for 2 minutes and allowing it to cool in air.

Under the above conditions, the following cooling cycles were recorded:

| Treatment Temp. | 600° F. | 750° F. | 850° F. |
|---|---|---|---|
| Cooling Rate (°F./min.) | | | |
| 1st Min. | 165 | 235 | 274 |
| 2nd Min. | 85 | 111 | 136 |
| 3rd Min. | 63 | 72 | 90 |
| 4th Min. | 44 | 63 | 59 |
| 5th Min. | 35 | 49 | 48 |
| Temp. at 5 Min. | 208 | 220 | 243 |
| Avg. Cooling Rate | 78°/Min. | 106°/Min. | 121°/Min. |

-continued for 5 Min.

The furnace cooling cycle was accomplished by means of a controller which was programmed to cool the furnace at a rate of 50° F. per hour after the material had soaked at the desired temperature for 30 minutes.

Figure 2:
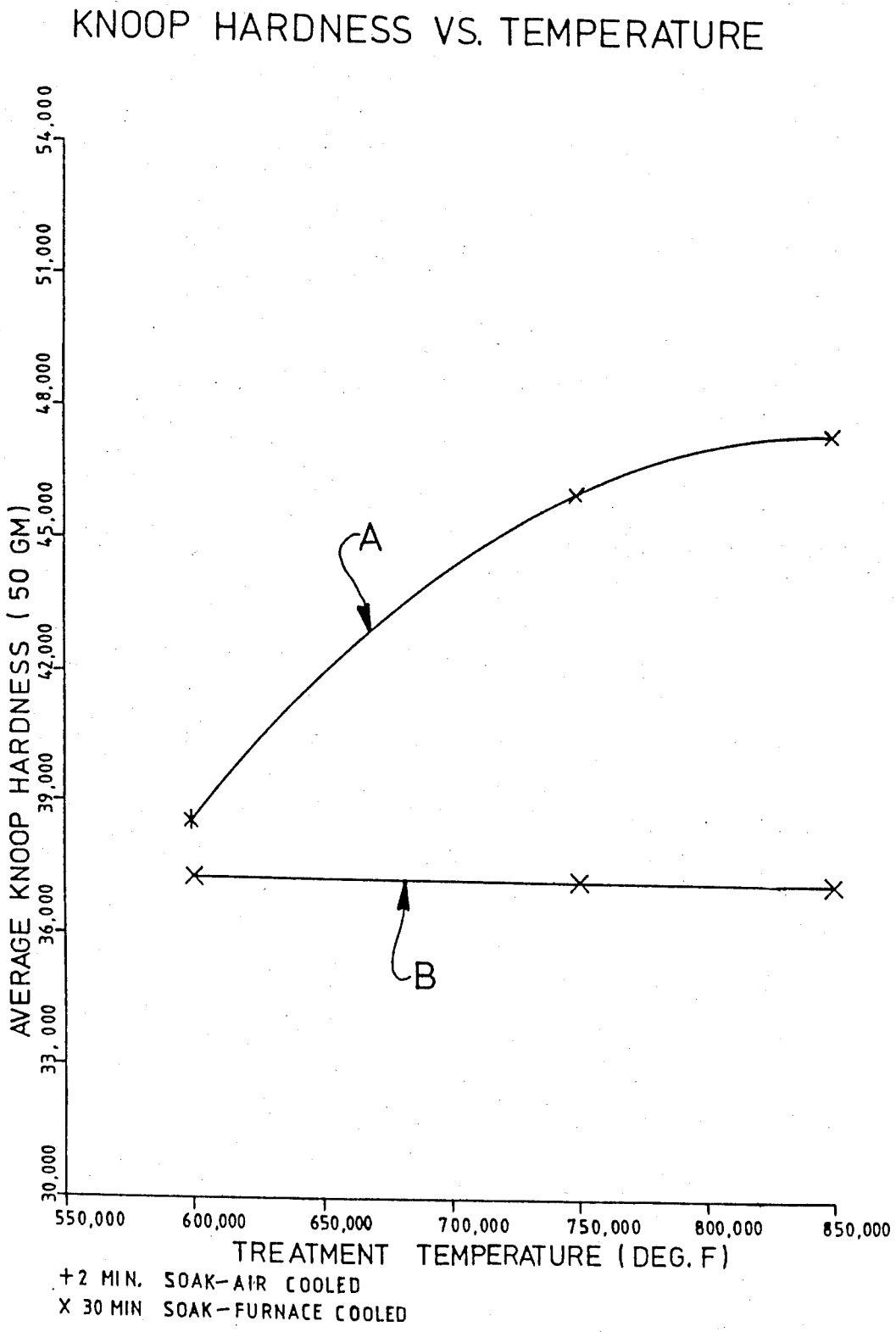

FIG. 2 illustrates the effect of the post clad thermal treatments on bearing alloy hardness as measured by the Knoop micro-hardness scale. Each point represents the average of 5 readings. Hardness is a fairly good indicator of the tensile and fatigue strength of the material.

In FIGS. 1 and 2 the properties of material processed according to the instant invention are shown in curve A whereas those of material outside of the scope of the invention are illustrated by curve B.

From the foreging it is noted that superior bearing material can be produced via the practice of the present invention.

While there have been described herein what are at present considered to be the preferred embodiments of this invention, it will be apparent to those skilled in the art that various changes and modifications may be made therein without departing from the invention, and it is, therefore, intended in the appended claims to cover all such changes and modifications as fall within the true spirit and scope of the invention.

We claim:

1. In the method of producing a powdered metal aluminum base bearing material having superior fatigue and anti-seizure properties which method comprises:

(a) simultaneously roll compacting three distinct layers of aluminum base powder particles, in which the bottom layer of said layers constitutes a powder metal bonding layer consisting essentially of more than 55 weight percent aluminum and the balance selected from a first group of additives consisting of silicon, copper, manganese, magnesium, nickel, iron, zinc, chromium, zirconium, titanium and mixtures thereof;

the intermediate layer of said layers constitutes a powder metal bearing layer consisting essentially of at least 55 up to about 95 weight percent aluminum, with the balance being selected from said first group of materials in an amount of 0 to about 20 weight percent and from a second group of bearing phase materials in the amount of 5 to 25 weight percent, said second group consisting of lead, tin, cadmium, bismuth, antimony and mixtures thereof;

the surface layer of said layers constitutes a sacrificial layer deposited on said powder metal bearing layer and consisting essentially of more than 50 weight percent of aluminum particles and the balance of additives selected from said first and second groups, with said aluminum and said bearing phase materials of said bearing layer being placed in prealloyed particle form to establish an intra-particle position relative to each other and the bearing phase particles in said sacrificial layer being formed for establishing an interstitial position therein relative to the aluminum particles;

(b) sintering the so-formed three-layered composite; and (c) roll cladding the bonding layer face to face onto a rigid backing layer;

wherein the improvement comprises:

heat treating the roll clad composite material in a continuous manner to a temperature from about 700° F. to about 900° F. for a period of at least thirty seconds and then convection cooling the material at an average rate of greater than 100° F./hr.

2. The method of claim 1 wherein the cooling rate is an average of at least 50° F./min. during the first three minutes of cooling.

3. The powdered metal aluminum base bearing material produced according to the method of claim 1.

4. The method of claim 1 wherein the roll clad composite material is maintained at a temperature of from about 700° F. to about 900° F. for a period of time ranging from at least 30 seconds to a maximum less than the time required for the formation of a brittle aluminum/iron intermetallic.

5. The method of claim 4 wherein said heating takes place at a temperature ranging from about 750° F. to about 800° F. and is maintained at said temperature for about two minutes.

6. In the method of producing a powered metal aluminum base bearing material having superior fatigue and anti-seizure properties which method comprises:

(a) simultaneously roll compacting three distinct layers of aluminum base powder particles, in which the bottom layer of said layers constitutes a powder metal bonding layer consisting essentially of more than 55 weight percent aluminum and the balance selected from a first group of additives consisting of silicon, copper, manganese, magnesium, nickel, iron, zinc, chromium, zirconium, titanium and mixtures thereof;

the intermediate layer of said layers constitutes a powder metal bearing layer consisting essentially of at least 55 up to about 95 weight percent aluminum, with the balance being selected from said first group of materials in an amount of 0 to about 20 weight percent and from a second group of bearing phase materials in the amount of 5 to 25 weight percent, said second group consisting of lead, tin, cadmium, bismuth, antimony and mixtures thereof;

the surface layer of said layers constitutes a sacrificial layer deposited on said powder metal bearing layer and consisting essentially of more than 50 weight percent of aluminum particles and the balance of additives selected from said first and second groups;

with said aluminum and said bearing phase materials of said bearing layer being placed in prealloyed particle form to establish an intra-particle position relative to each other and the bearing phase particles in said sacrificial layer being formed for establishing an interstitial position therein relative to the aluminum particles;

(b) sintering the so-formed three-layered composite;

(c) roll cladding the bonding layer face to face onto a rigid backing layer; and (d) heat treating the roll clad composite material in a continuous manner to a temperature from about 700° F. to about 900° F. for a period of at least thirty seconds and then convection cooling the material at an average rate of greater than 100° F./hr. and wherein the cooling rate is an average of at least 50° F./min. during the first three minutes of cooling.

* * * * *